US007591090B2

(12) United States Patent
Florean

(10) Patent No.: US 7,591,090 B2
(45) Date of Patent: Sep. 22, 2009

(54) CIVIL ENGINEERING LOADING MACHINE

(75) Inventor: Gilles Florean, Belley (FR)

(73) Assignee: Volvo Vompact Equipment SAS, Belley (FR)

( * ) Notice: Subject to any disclaimer, the term of this patent is extended or adjusted under 35 U.S.C. 154(b) by 0 days.

(21) Appl. No.: 11/997,701

(22) PCT Filed: Aug. 2, 2005

(86) PCT No.: PCT/FR2005/050641

§ 371 (c)(1),
(2), (4) Date: Apr. 29, 2008

(87) PCT Pub. No.: WO2007/014985

PCT Pub. Date: Feb. 8, 2007

(65) Prior Publication Data

US 2008/0244937 A1 Oct. 9, 2008

(51) Int. Cl.
*E02F 3/64* (2006.01)

(52) U.S. Cl. ..... 37/416

(58) Field of Classification Search ..... 37/348, 37/382, 409, 410, 416, 466; 414/700, 701, 414/708, 815; 172/1–6, 10, 700, 272–275, 172/776, 274

See application file for complete search history.

(56) References Cited

U.S. PATENT DOCUMENTS

| | | | | |
|---|---|---|---|---|
| 2,883,077 | A | 4/1959 | Pilch | |
| 3,550,794 | A | 12/1970 | Suverkrop | |
| 3,872,990 | A | 3/1975 | York et al. | |
| 4,372,729 | A | 2/1983 | Buschbom et al. | |
| 6,609,315 | B1 * | 8/2003 | Hendron et al. | 37/348 |
| 6,912,804 | B2 * | 7/2005 | Charles | 37/348 |
| 7,059,422 | B2 * | 6/2006 | Burgin | 172/776 |
| 2004/0060711 | A1 | 4/2004 | Georges | |

FOREIGN PATENT DOCUMENTS

| | | | |
|---|---|---|---|
| EP | 0597657 | A | 5/1994 |
| FR | 2596378 | A | 10/1987 |
| WO | 20050052265 | A | 2/2008 |

OTHER PUBLICATIONS

PCT International Search Report for PCT/FR2005/050641, Issued on Apr. 20, 2006.

* cited by examiner

*Primary Examiner*—Robert E Pezzuto
(74) *Attorney, Agent, or Firm*—Novak Druce + Quigg, LLP

(57) ABSTRACT

A loading machine has working equipment which includes at least one arm, an actuator for displacing the arm, a working tool hingable with respect to the arm, a main kinematic chain forming together with the working tool part and the arm part a main deformable mechanism and a controllable tool actuator for deforming the main deformable mechanism to cause the tool to tilt. The machine also has a secondary kinematic chain forming together with the part of the arm, which is located in the area of articulation thereof on the frame, a deformable reference mechanism whose deformation directly corresponds to the inclination angle of the working tool, an angle sensor for measuring an angle displaying the deformation of the reference mechanism with respect to the frame, and a control device which is connected to the sensor and controls the feeding of the working tool actuator and/or the arm actuator.

7 Claims, 4 Drawing Sheets

CIVIL ENGINEERING LOADING MACHINE

TECHNICAL FIELD

The invention relates to the field of civil engineering machines and more particularly to machines of the loader type. Its object is more precisely a device making it possible to measure the inclination of a mobile working implement of the machine. A particular application of the present invention makes it possible to automatically correct the inclination of the bucket during the various loading operations.

PRIOR ART

Usually, a civil engineering machine that makes it possible to pick up goods, such as materials, placed on the ground in order to dump them into a trailer body or into a truck or vice versa is called a "loader". A loader therefore in a known manner comprises a chassis and particular working equipment. This working equipment usually includes an arm that is articulated relative to the chassis. This arm may be raised under the action of a cylinder usually called an "arm cylinder".

One of the ends of the arm receives a working implement, such as a bucket, which is itself articulated relative to the arm. To move the working implement relative to the arm, the working equipment also comprises an assembly of link rods which form, together with a portion of the working implement and a portion of the arm, a deformable quadrilateral. Usually, one of these link rods is articulated relative to the working implement, while the other is articulated relative to the arm, these two link rods being articulated with one another via their ends. The working equipment also comprises an implement cylinder that is controlled to deform the deformable quadrilateral, which makes it possible to incline the working implement relative to the arm.

The driver may control, via a most frequently hydraulic manipulator, the arm cylinder and the implement cylinder separately. Therefore, by acting on the arm cylinder, he lifts the arm while raising the level of the working implement.

By acting on the implement cylinder, he modifies the inclination of the bucket relative to the arm, and therefore relative to the chassis. Therefore, after the working implement, such as a bucket, has been loaded with goods or filled with materials, it is pivoted rearward so that its opening is oriented upward. Conversely, when the bucket has reached the desired height, it is pivoted forward, so as to be emptied into the receiving trailer body.

When one of the arm or implement cylinders is operated, since the working implement is placed at the end of the arm, when the length of the latter varies, the inclination of the arm and/or of the working implement varies relative to the ground. It is often desirable, or even indispensable, to know the value of the angle of inclination of the working implement. This is the case, for example, when the implement is a bucket loaded with materials that may risk inclining too much and consequently dumping its load unexpectedly, which may cause problems of safety, of material breakage and/or waste of time.

Preventing the working implement from losing its goods is one of the reasons that justify the need to be able to measure the angle of inclination of the working implement relative to the ground. This measurement makes it possible specifically to modify the inclination of the working implement relative to the arm by manipulating the deformation of the deformable quadrilateral. During the movement of raising the arm, the implement cylinder may therefore be actuated to keep the opening of the working implement in a constant inclination, in order to prevent the latter from dumping rearward unexpectedly.

Document US-A-2004/0060711 describes a device capable of transmitting the measurement of the inclination of the working implement to an actuator capable of acting appropriately on the cylinder of the working implement by means of a hydraulic system in order to compensate for the inclination of the working implement under the effect of the variation of inclination of the arm. This device comprises a cam mechanism moved by a connecting bar also connected to the deformable quadrilateral. In this arrangement, the position of the cam is a direct function of the inclination of the working implement.

However, this device is not very adaptable to the various working implements that are likely to be mounted on the arm as required. Specifically, the cam, through its particular profile, often according to an involute to a circle, is specific to a determined geometry of the working implement. If the user wishes to change the working implement, he must also install the cam that is appropriate to the geometry of the new implement or, more simply, adjust the length of the connecting bar that is made to be adjustable. Otherwise the compensation of inclination is incorrect and the aforementioned problems may occur.

Document EP-A-0 597 657 also teaches of a machine whose working implement and arm are each fitted with an angular sensor in order to determine their respective inclination then to control the cylinders according to the signals transmitted by the angular sensors, so as to prevent the goods carried by the working implement from being tipped.

However, in such a device failures of the angular sensors may occur, particularly of the sensor situated close to the implement, because they are positioned at a distance from the chassis. Specifically, they are therefore exposed to vibrations, to impacts and to elements causing deterioration or disruption of measurement such as rain, dust or mud, which may over time damage these angular sensors despite their sealed manufacture. Consequently, these sensors may no longer operate at all or may operate erratically and, in consequence, transmit incorrect information.

In the same manner, the electric wires that connect these angular sensors to a computing unit or to an actuator to transmit the measurement signals are exposed to the same disruptive elements and therefore risk the same consequences.

In addition, the change of working implement there again poses an adaptation problem. Specifically, it is necessary to carry out a calibration operation on the computing unit to take account of the signals sent by the sensor according to the shape and dimensions of the new implement. Specifically, the behavior of the kinematic linkage changes on this occasion.

A first problem that the invention proposes to solve is that of making it possible to measure the inclination of the working implement reliably. Another problem that the invention seeks to solve is that of allowing an automatic correction of the inclination of the working implement based on the inclination measurement taken.

DESCRIPTION OF THE INVENTION

The invention therefore relates to a civil engineering machine of the "loader" type. Such a machine comprises a chassis and working equipment. The working equipment comprises:

at least one arm that can move relative to the chassis, an arm cylinder, of which one end is connected to the arm and the other to the chassis, and capable of rotating the arm relative to the chassis, a working implement articulated relative to the arm, a main kinematic linkage forming, with a portion of the working implement and a portion of the arm, a main deformable mechanism, an implement cylinder capable of being controlled to cause the deformation of the main deformable mechanism in order to ensure the inclination of the working implement relative to the arm, a hydraulic control circuit allowing the implement cylinder to be supplied by means of a directional flow valve.

According to the invention, the working equipment also comprises:

a secondary kinematic linkage forming, with a portion of the arm situated in the zone of articulation of the arm on the chassis, a deformable telltale mechanism whose deformation is a direct function of the inclination of the working implement relative to the chassis, an angular sensor capable of measuring an angle representative of the deformation of the telltale mechanism, a command and control device connected to said angular sensor and capable of controlling the supply of the implement cylinder and/or of the arm cylinder.

In other words, the machine that is the subject of the invention comprises a telltale mechanism that corresponds to a "copy" of the main working mechanism and which faithfully and mechanically imitates the movements of it, so that an angular sensor measures an inclination-image. This inclination-image is representative of the inclination of the working implement. Since the telltale mechanism is shifted closer to the chassis, it is less exposed to the elements causing deterioration or disruption of the inclination measurement. The inclination of the bucket is therefore controlled in a closed loop which provides advantages in terms of precision.

According to an advantageous embodiment of the invention, the main kinematic linkage (20, 21) is formed by an assembly of link rods defining a main deformable quadrilateral, and the secondary kinematic linkage is formed by an assembly of small link rods (40, 41, 42, 43) defining a deformable telltale quadrilateral (35), whose deformation is a direct function of the inclination (100) of the working implement (15) relative to the chassis (5).

Advantageously, the dimensions of the telltale mechanism may correspond to a homothetic reduction of the dimensions of the main deformable mechanism. Therefore, the telltale mechanism produces a faithful image of the main deformable mechanism.

Advantageously, the telltale mechanism may be deformable under the mechanical action of a movement transmission member. In other words, this member mechanically sends information of the angle of inclination of the working implement relative to the chassis. This connecting bar causes the telltale mechanism to rotate. Such a member therefore makes it possible to faithfully transmit the movement of the deformable quadrilateral to the telltale mechanism and, consequently, to transmit the angle of inclination to be measured.

According to a practical embodiment of the invention, the movement transmission member may comprise a rigid bar articulated at one end on one of the link rods forming the main mechanism and at the other end in the zone of attachment of the arm to the chassis.

In a particularly advantageous manner, the machine may also comprise:

a hydraulic compensation device making it possible to generate an additional control pressure in order to move the implement cylinder according to the signal transmitted by the angular sensor, a circuit selector capable of transmitting to the directional flow valve the higher of the control pressure delivered by the manipulator and the additional control pressure, so that the inclination of the working implement is kept generally constant irrespective of the controls applied by the driver on the manipulator. Therefore, the unexpected dumping of the goods is prevented, whether it is on the cabin side for materials contained in a bucket or on the side external to the machine for goods installed on a pallet, which is likely to slip forward along forks that are overinclined.

The hydraulic device is therefore capable of automatically keeping the working implement in a substantially horizontal inclination, so as to keep the goods in the working implement.

BRIEF DESCRIPTION OF THE DRAWINGS

The manner of embodying the invention and the advantages that result therefrom will clearly emerge from the description of the embodiment that follows supported by the appended figures in which.

MANNER OF EMBODYING THE INVENTION

Figure 1:
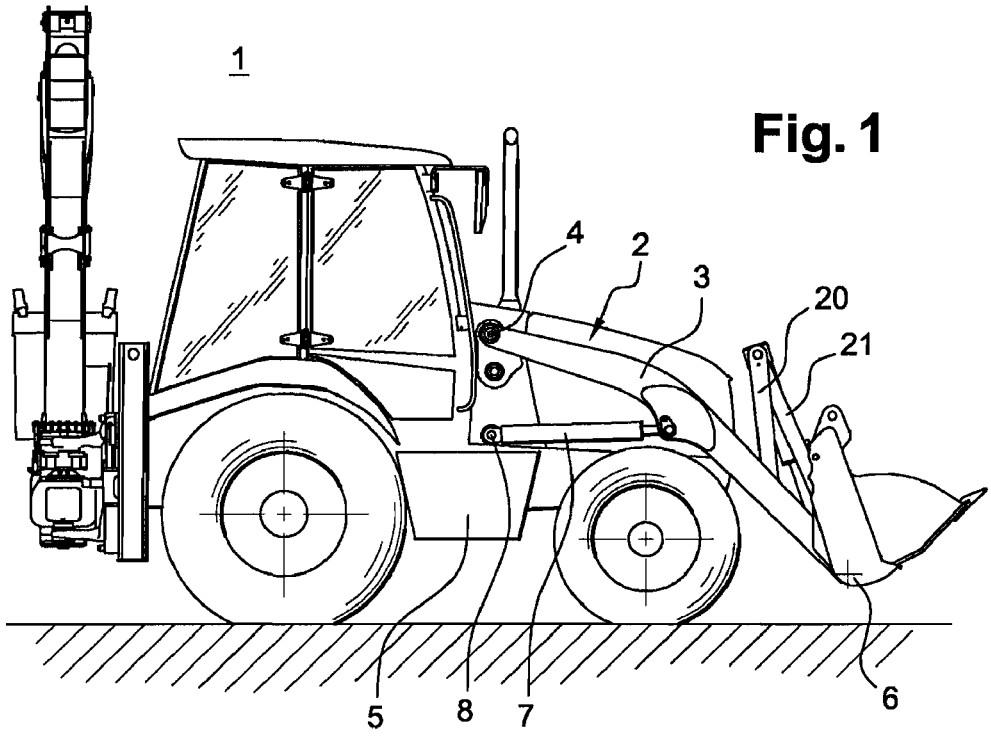
FIG. 1 is a general side view of a machine of the loader/backhoe type.

As already explained, the invention relates to a civil engineering machine having a "loader" function, and for example a "backhoe-loader" as illustrated in FIG. 1. In its front portion, this machine 1 comprises working equipment 2 allowing it to perform the function of a loader. This working equipment 2 consists mainly of two arms 3 situated on either side of the machine. At its rear end 4, these arms 3 are articulated on the chassis 5.

These arms 3 have a slightly curved shape so that their front ends 6 are substantially level with the ground in the lowest position of the arms 3. These arms 3 may be moved under the action of arm cylinders 7 also situated on either side of the chassis 5. These cylinders 7 are articulated at one end 8 on the chassis, and at their opposite ends 9 on the main arms 3, substantially at the mid-level 10 of the latter.

The actuators for moving the movable members are in this instance linear hydraulic cylinders, but they could equally be rotary, pneumatic cylinders or else electric motors, all equally capable of rotating the arms of the machine. In addition, the linear cylinders employed may be connected to the parts to be moved at their ends, or at any point of their structure. Similarly, nevertheless without departing from the context of the invention, the machine may also comprise only one arm instead of two.

At their front ends 6, the main arms 3 receive a working implement that is advantageously interchangeable if it is mounted on an implement-carrier. In this instance, the working implement represented in the figures is a bucket 15. Nevertheless, it could be another working implement, such as a fork for transporting pallets. In the rest of the description, the working implement 15 and its carrier will be assimilated because the interchangeability of the implement does not form a determinate feature of the present invention.

This bucket 15 is articulated relative to the arms 3, so that it can be inclined at different angles. In this manner, the opening 16 of the bucket may be inclined either toward the front when materials 17 are to be loaded into it, or toward the rear when the bucket 15 is full and it is moved.

In the embodiment illustrated corresponding therefore to one side of the working equipment 2, two link rods 20, 21 form, with the terminal portion (on the working implement side) of one or the other arm 3 and a portion of the bucket 15, a main deformable quadrilateral which defines four apexes 60, 61, 62, 63. More precisely, the working equipment 2 comprises a first rear link rod 20 which is articulated on the arm 3 at the apex 64 of the quadrilateral situated at one end of the link rod 20.

The equipment also comprises a front link rod 21 which is articulated at each end on the one hand on the bucket 15, and on the other hand on the implement cylinder 27 and the link rod 20, at the apex 60 and the apex 61 of the deformable working quadrilateral. The two link rods, front 21 and rear 20, are therefore articulated with one another at their top ends 25. The articulations are in this instance achieved by means of pivot links known to those skilled in the art. Therefore, when the inclination of the bucket 15 varies relative to the arm 3, the deformable quadrilateral including the link rods 20, 21 deforms.

This deformation of the deformable quadrilateral is caused by the action of an implement cylinder 27. This implement cylinder 27 has a rod 28 that is articulated on the bucket 15, substantially between the articulation point situated at the apex 62 of the front link rod 21 and the articulation point 13 of the bucket relative to the arm 3. The end situated on the side of the chamber 29 of the implement cylinder 27 is, for its part, connected to the common articulation point 25 of the two link rods, front 21 and rear 20. Therefore, when a force is applied by the implement cylinder 27, the latter causes the common articulation point 25 of the link rods to move closer to or further from the bucket 15, and therefore deforms the deformable quadrilateral and consequently, varies the inclination of the bucket 15 relative to the arm 3.

The main mechanism is therefore in this instance a main deformable quadrilateral, just as the telltale mechanism 35 is a telltale quadrilateral. Similarly, the main kinematic linkage consists of an assembly of link rods, just like the secondary kinematic linkage.

In addition, to allow a measurement of the inclination 100 of the working implement, the machine 1 comprises a connecting bar 30 that extends essentially along the arm 3 and parallel to it, substantially from the zone where the rear link rod 20 is articulated to the articulation point 4 of said arm 3 relative to the chassis 5. The front end 31 of this connecting bar 30 is articulated on the rear connecting rod 20, at an articulation point 32.

Figure 3:
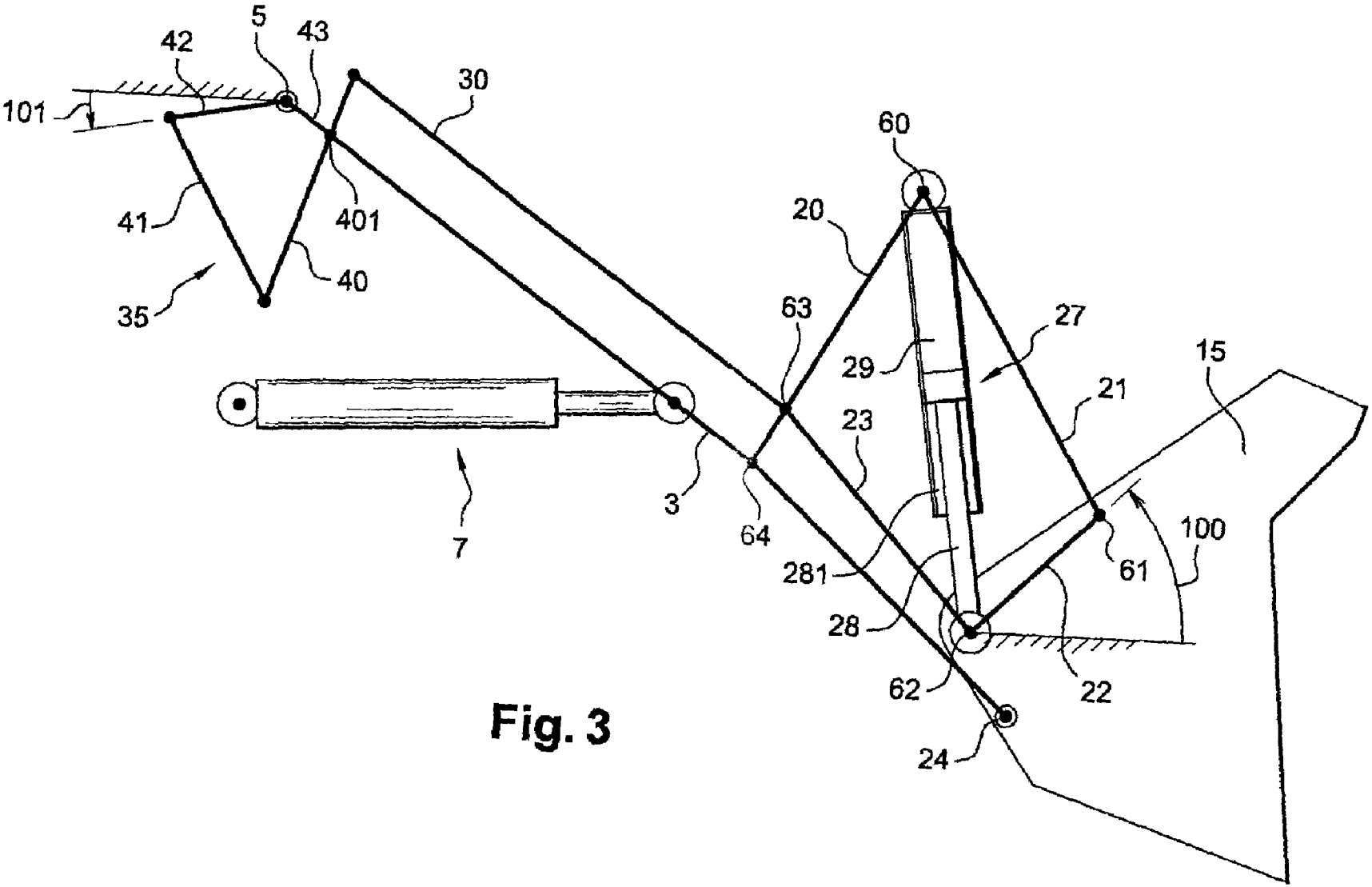
FIG. 3 is a kinematic diagram of the working equipment of a machine according to the invention.

The other end 33 of the connecting bar 30 is itself articulated substantially at the articulation point 4 of the arm 3 relative to the chassis 5. More precisely, this end 33 of the connecting bar is articulated jointly with a telltale quadrilateral 35 as schematically illustrated in FIG. 3.

Figure 2:
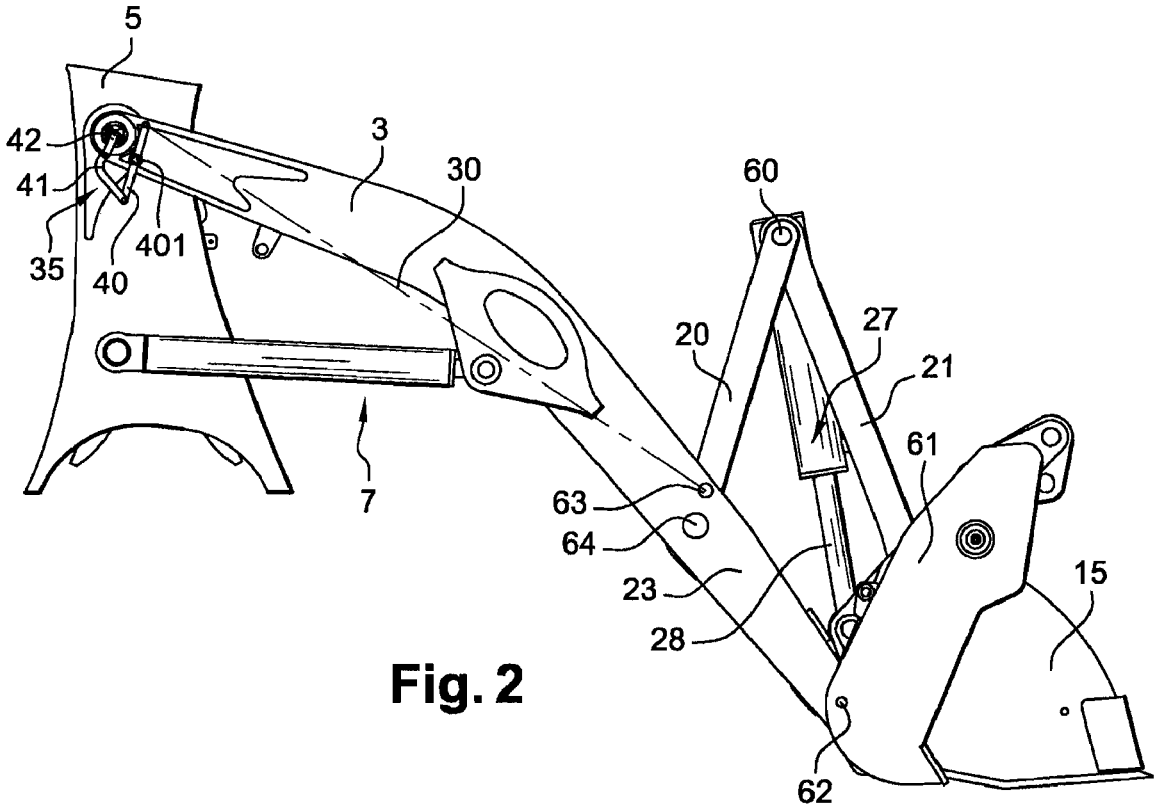
FIG. 2 is a side view of the working equipment of the loader of FIG. 1 shown in two different positions of the arm.

The connecting bar 30 therefore defines a closed contour articulated at four points by means of pivot links whose axes are perpendicular to the plane containing the arm 3 and the connecting bar 30. Since the arm may be curved (FIGS. 1 and 2), this contour is not necessarily a quadrilateral like those appearing in FIGS. 3 and 4.

This telltale quadrilateral 35 is formed by an assembly of small link rods 40, 41, 42, 43, a portion of the working implement 15 and a portion of the arm 3 situated in the zone of articulation of the arm 4 on the chassis 5. Like the working quadrilateral, pivot links articulate these small link rods with one another so as to render the telltale quadrilateral 35 deformable. The articulations are in this instance also made by means of pivot links known to those skilled in the art. Like the working quadrilateral, the telltale quadrilateral 35 may comprise one or more curved small link rods 40, 41, 42, 43, as appears in FIGS. 4 and 5.

In addition, the dimensions of the small link rods 40, 41, 42, 43 are chosen so that the telltale quadrilateral 35 forms a homothetic reduction, hence a faithful image, of the working quadrilateral. The apexes of origin of the deformable working quadrilateral each have an apex-image in the telltale quadrilateral 35.

In addition, because of the homothetic construction, the lengths of the small link rods 40 and 41 correspond respectively to the lengths of the link rods 20 and 21, each multiplied by a reduction factor K, that is to say lying between 0 and 1. The lengths of the small link rods 42 and 43 correspond respectively to the multiples, by this same factor K, of the lengths 22 and 23 of the portions separating respectively the apexes 61 and 62 on the one hand, and 62 and 63 on the other hand. For convenience of representation, the figures are not to scale. Therefore, the telltale quadrilateral 35 is represented respectively bigger than in the majority of real cases.

On the other hand, a homothetic transformation retains the angles. Therefore, the angles at the apex-images of the telltale quadrilateral 35 are equal to the angles at the apexes of origin of the deformable working quadrilateral. In practice, this is true if the functional clearances necessary to the mobility of the parts forming the machine are excluded.

Furthermore, the telltale quadrilateral 35 is capable of deforming under the mechanical action of a movement transmission member. This member consists of a rigid bar 30 articulated at one end on one of the link rods 20 forming the working quadrilateral and at the other end in the zone 4 of attachment of the arm 3 to the chassis 5.

Therefore, when the quadrilateral deforms, this bar 30 may mechanically transmit the information of the angle of inclination 100 of the working implement relative to the chassis 5. This bar 30 causes the deformation of the telltale quadrilateral 35 by means of a small link rod 40 of the telltale quadrilateral that is articulated on the connection 401. The bar 30 therefore makes it possible to reliably transmit the movement of the working quadrilateral to the telltale quadrilateral 35. Since the dimensions of the telltale quadrilateral 35 are chosen so as to correspond to a homothetic reduction of the dimensions of the deformable working quadrilateral, the deformation of the telltale quadrilateral 35 and, consequently, the angle of inclination 101 to be measured between one of the small link rods, for example the link rod 42, and the chassis 5 are therefore a direct function of the inclination 100 of the working implement 15 relative to the chassis 5.

Clearly, the rigid bar 30 playing the role of a movement transmission member may be replaced by any other equivalent system, such as for example by one or more flexible and inextensible cables suitably disposed, nevertheless without departing from the subject of the invention.

Under the action of the rigid bar 30, the telltale quadrilateral 35 is therefore capable of deforming when the working quadrilateral deforms. That is why this second quadrilateral 35 is called the "telltale" quadrilateral.

In addition, an angular sensor 44 is installed on the telltale quadrilateral 35 in order to measure the inclination 101 of the small link rod 42, when the latter moves, jointly with the deformable working quadrilateral, under the action of the rigid bar 30. In practice, the angular sensor 44 may be a goniometer or any other measurement instrument making it possible to determine, directly or indirectly, the angle of inclination 101 of one of the small link rods 40, 41, 42, 43 of the telltale quadrilateral 35. Because of the construction explained above, the angular sensor 44 therefore makes it possible to determine the inclination 100 of the working implement relative to the chassis 5.

It is understood that such a device has the advantage of being adaptable to various working implements 15 likely to be mounted on the arm 3, whether it be a bucket of different geometry or a fork or any other implement.

In addition, such a device can operate in a reliable and durable manner because the angular sensor 44 is not situated at a distance from the chassis, but, on the contrary, is close to the latter. It is therefore little exposed to elements causing deterioration or disruptions of measurement such as vibrations, impacts, rain, dust or mud; just like any electric wires for transmitting the measurements that it makes. This device therefore provides a reliable and easily exploitable measurement of the inclination of the bucket 15 relative to the chassis. In addition, through its construction and arrangement, the device is robust and may therefore provide measurements in a reliable manner without risk of failure.

Furthermore, the changing of the working implement poses no problem of adaptation to various working implements because the telltale quadrilateral will always sustain a deformation that is directly representative of the inclination of the working implement.

The angular sensor 44 is incorporated into the hydraulic control circuit of the cylinders 7, 27 so as to form a closed loop with the actuators that the cylinders 7, 27 form.

Therefore, the machine 1 also comprises a hydraulic manipulator 58 which the driver of the machine 1 operates. The hydraulic manipulator 58 delivers a control pressure to a hydraulic directional flow valve 46 connected to each of the chambers 29, 281 of the implement cylinder 27 so as to control the arm cylinder 7 and/or the implement cylinder 27 and, consequently, to modify the respective inclinations of the arms 3 and/or the implement 15 to complete the work to be done.

Figure 4:
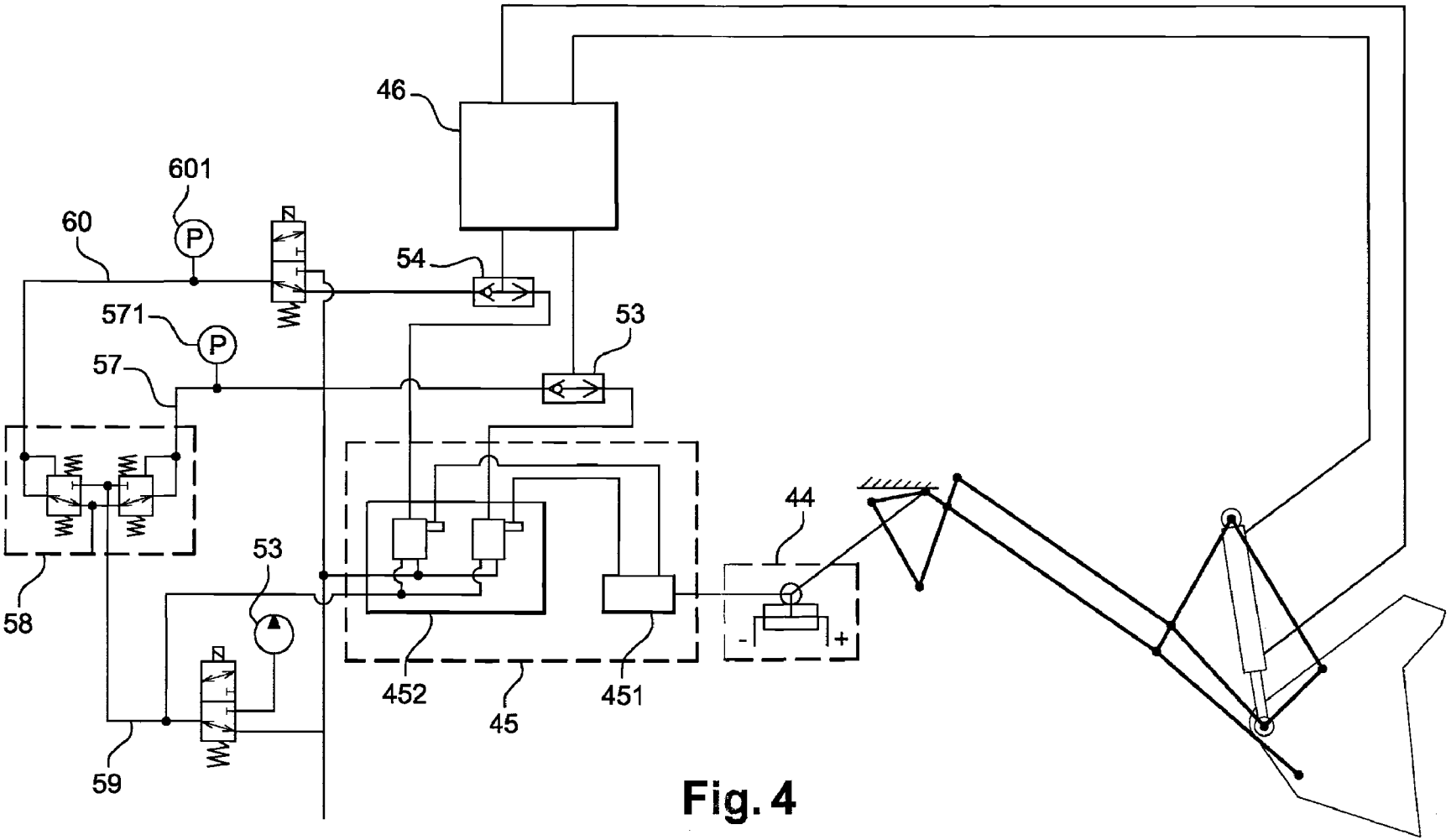
FIG. 4 represents a diagram similar to that of FIG. 3, to which is added the hydraulic circuit of a machine according to the invention.
Figure 5:
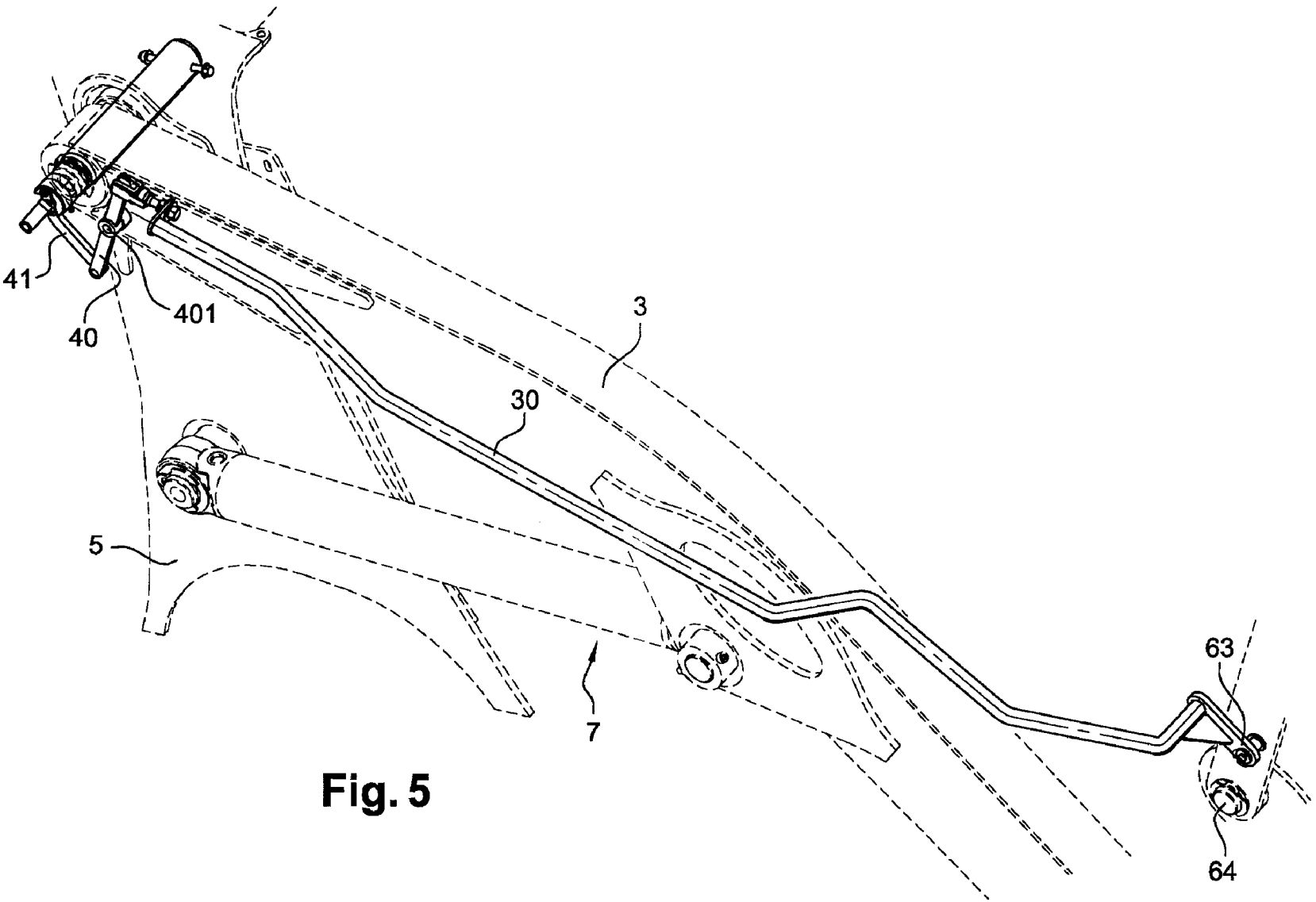
FIG. 5 is a perspective view illustrating a telltale quadrilateral according to one embodiment of the invention.

According to a practical embodiment of the invention, as illustrated in FIG. 4, the machine 1 also comprises an electrohydraulic compensation device 45 making it possible to generate an additional control pressure capable of moving the implement cylinder 27.

This electrohydraulic compensation device 45 in this instance comprises two solenoid valves 452, connected upstream to the main source of pressure that is the pump 53 and an electronic computer 451. Each solenoid valve 452 controls one of the two circuits for supplying the chambers 29, 281 of the implement cylinder 27, that is to say the dumping circuit or crowding circuit to incline the bucket 15 respectively toward the front or toward the rear. The electronic computer 451 drives these two solenoid valves 452 through electric signals that are a function of the signals sent by the angular sensor 44 to the electronic computer 451, signals that are representative of the inclination 101 of a small link rod 40, 41, 42 or 43 of the telltale quadrilateral, as explained above.

Therefore, when the arms 3 incline under the action of their cylinders 7, the telltale quadrilateral 35 deforms causing a change in the measurement of the angle of inclination 101 of the bucket 15, hence a change of instruction at the solenoid valves 452, then a change of supply of the hydraulic directional flow valve 46 and finally of the implement cylinder 27. Consequently, the implement cylinder 27 is inclined so as to compensate for the inclination of the arms 3 thereby keeping the inclination 100 of the bucket 15 constant.

To manage the conflict of priorities arising from the juxtaposition of a manual control and an automatic compensation control, pressure sensors 601, 571 are installed on the dump and lift ducts in order to measure the pressures thereof originating from the manual controls. As a function of these measurements, the electronic system disables the automatic correction function, in order to give priority to the user, who may therefore modify the position of the bucket 15 as he wishes.

When the user does not act on the manipulator 58, the control pressures fall below a threshold, so that the pressure sensors 601, 571 deliver a null signal. At this precise moment, an angle position instruction is stored in an electronic memory, if necessary incorporated into the electronic computer 451 so as to preserve the inclination of the bucket 15 during subsequent raising and lowering movements of the arm 3. The correction is made only during the raising or lowering of the arms 3.

In addition, the control members of the dump and lift circuits, namely the manipulator 58 and the solenoid valves 452, are connected to a circuit selector 54 whose downstream output is connected to the power directional flow valve 46 in order to transmit to it the higher of the control pressure delivered by the manipulator 58 and the additional control pressure delivered by one of the solenoid valves 452. Therefore, priority is given to the most "important" instruction, so that the user is capable of controlling the bucket 15 while being sure of obtaining compensation in the case of excessive inclination 100. Consequently, the inclination 100 of the bucket 15 is kept generally constant when no control is applied by the driver to the manipulator 58, while the inclination of the arm 3 varies.

More precisely, the control manipulator 58 has a pressure supply 59 from the main pump 53, and two outlet channels 57, 60 each corresponding to a direction of inclination of the working implement, in this instance of the bucket 15. The first outlet 60 corresponds to the command to raise the bucket 15, while the second outlet 57 corresponds to the command to dump the bucket 15.

Therefore, the circuit selector 54 transmits to the directional flow valve 46 the pressure that is the greatest between the pressure for controlling the manipulator 58 and the pressure delivered by the electrohydraulic device 45. It is this pressure that then acts on the directional flow valve 46 that causes the movement of the implement cylinder 27.

In practice, when the pressure delivered by the manipulator 58 is greater than that originating from the electrohydraulic device 45, it is the pressure value originating from the manipulator 58 that acts on the directional flow valve 46. Conversely, when the inclination 100 of the working implement induces a movement of the rigid bar 35 such that the pressure delivered by the electrohydraulic device 45 is greater than that originating from the manipulator 58, this correction pressure originating from the electrohydraulic device 45 acts on the directional flow valve 46.

In other words, and according to a variant of the invention, the system automatically compensates for the inclination 100 of the bucket 15 in order to prevent the latter from dumping rearward, if it remains in the initial inclination, corresponding to that of the bottom portion, that is to say close to the ground.

As a variant, the dimensions of the small link rods of the telltale quadrilateral may not produce a homothetic reduction of the working quadrilateral. In this case, a correction by the computer may be envisaged if the curve of variation of the angle of the small link rod as a function of the inclination of the working implement is known.

The result of the foregoing is that the machine according to the invention has the essential advantage of allowing a reliable measurement of the inclination of the working implement. This measurement allows this inclination to be controlled in a closed loop. This control may take place automatically to allow an automatic correction of the inclination of the working implement when it is raised. Consequently, the present invention makes it possible to increase the safety of the driver, because the risk of materials falling toward the rear is eliminated.

The invention claimed is:

1. A loader-type civil engineering machine having a chassis and working equipment, comprising:

at least one arm that can move relative to the chassis, an arm cylinder, of which one end is connected to the arm and the other to the chassis, and capable of rotating the arm relative to the chassis, a working implement articulated relative to the arm, a main kinematic linkage forming, with a portion of the working implement and a portion of the arm, a main deformable mechanism, an implement cylinder capable of being controlled to cause deformation of the main deformable mechanism in order to ensure inclination of the working implement relative to the arm, a hydraulic control circuit allowing the implement cylinder to be supplied by means of a directional flow valve, a secondary kinematic linage forming, with a portion of the arm situated in the zone of articulation of the arm on the chassis, a deformable telltale mechanism whose deformation is a direct function of the inclination of the working implement relative to the chassis, an angular sensor capable of measuring an angle representative of the deformation of the telltale mechanism relative to the chassis, and a command and control device connected to said angular sensor and capable of controlling the supply of the implement cylinder and/or of the arm cylinder.

2. The machine as claimed in claim 1, wherein the main kinematic linkage is formed by an assembly of link rods defining a main deformable quadrilateral, and wherein the secondary kinematic linkage is formed by an assembly of small link rods defining a deformable telltale quadrilateral, whose deformation is a direct function of the inclination of the working implement relative to the chassis.

3. The machine as claimed in claim 1 or 2, wherein the dimensions of the telltale mechanism correspond to a homothetic reduction of the dimensions of the main deformable mechanism.

4. The machine as claimed in claim 1 or 2, wherein the telltale mechanism may be deformed under the mechanical action of a movement transmission member connected to the main deformable mechanism.

5. The machine as claimed in claim 4, wherein the movement transmission member comprises a rigid bar articulated at one end on the main kinematic linkage and at the other end in the zone of attachment of the arm to the chassis.

6. The machine as claimed in claim 1 or 2, wherein said machine comprises a hydraulic manipulator delivering a control pressure and capable of controlling the arm cylinder and/or the implement cylinder.

7. The machine as claimed in claim 1 or 2, wherein said machine also comprises:

a hydraulic compensation device making it possible to generate an additional control pressure in order to move the implement cylinder according to the signal transmitted by the angular sensor, and a circuit selector capable of transmitting to the directional flow valve the higher of the control pressure delivered by the manipulator and the additional control pressure, whereby the inclination of the working implement is kept generally constant irrespective of the controls applied by the driver on the manipulator.

* * * * *

UNITED STATES PATENT AND TRADEMARK OFFICE

CERTIFICATE OF CORRECTION

PATENT NO. : 7,591,090 B2
APPLICATION NO. : 11/997701
DATED : September 22, 2009
INVENTOR(S) : Gilles Florean It is certified that error appears in the above-identified patent and that said Letters Patent is hereby corrected as shown below:

Title page, item[73], Col. 1, please correct Assignee name "Volvo Vompact Equipment SAS" to read as follows:

--Volvo Compact Equipment SAS--

Signed and Sealed this

Twenty-fourth Day of November, 2009

David J. Kappos

David J. Kappos
*Director of the United States Patent and Trademark Office*